US006588506B2

(12) United States Patent
Jones

(10) Patent No.: US 6,588,506 B2
(45) Date of Patent: Jul. 8, 2003

(54) METHOD AND APPARATUS FOR GRAVEL PACKING A WELL

(75) Inventor: Lloyd G. Jones, Granbury, TX (US)

(73) Assignee: ExxonMobil Corporation, Irvine, TX (US)

( * ) Notice: Subject to any disclaimer, the term of this patent is extended or adjusted under 35 U.S.C. 154(b) by 0 days.

(21) Appl. No.: 09/866,289

(22) Filed: May 25, 2001

(65) Prior Publication Data

US 2002/0174984 A1 Nov. 28, 2002

(51) Int. Cl.[7] ..... E21B 43/04
(52) U.S. Cl. ..... 166/278; 166/51; 166/276
(58) Field of Search ..... 166/278, 51, 276, 166/231, 233, 235

(56) References Cited

U.S. PATENT DOCUMENTS

| | | | | |
|---|---|---|---|---|
| 2,224,630 | A | 12/1940 | Dean et al. | 166/1 |
| 3,153,451 | A | 10/1964 | Chancellor et al. | 166/51 |
| 3,548,935 | A | 12/1970 | Harkins | 166/51 |
| 3,637,010 | A | 1/1972 | Maly et al. | 166/51 |
| 3,802,500 | A | 4/1974 | Schmidt | 166/51 |
| 3,830,294 | A | 8/1974 | Swanson, Jr. | 166/51 |
| 3,963,076 | A | 6/1976 | Winslow | 166/278 |
| 3,999,608 | A | 12/1976 | Smith | 166/278 |
| 4,018,282 | A | 4/1977 | Graham et al. | 166/278 |
| 4,018,283 | A | 4/1977 | Watkins | 166/278 |
| 4,044,832 | A | 8/1977 | Richard et al. | 166/278 |
| 4,046,198 | A | 9/1977 | Gruesbeck et al. | 166/278 |
| 4,127,173 | A | 11/1978 | Watkins et al. | 166/276 |
| 4,192,375 | A | 3/1980 | Maly et al. | 166/51 |
| 4,253,522 | A | 3/1981 | Setterberg, Jr. | 166/278 |
| 4,393,932 | A | 7/1983 | Bodine | 166/249 |
| 4,418,754 | A | 12/1983 | Stepp | 166/278 |
| 4,469,178 | A | 9/1984 | Solum | 166/278 |
| 4,522,264 | A | 6/1985 | McNeer | 166/278 |
| 4,553,595 | A | 11/1985 | Huang et al. | 166/278 |
| 4,558,742 | A | 12/1985 | Huang et al. | 166/278 |
| 4,570,714 | A | 2/1986 | Turner et al. | 166/278 |
| 4,657,079 | A | 4/1987 | Nagaoka | 166/231 |
| 4,681,163 | A | 7/1987 | Guidry et al. | 166/278 |
| 4,685,519 | A | 8/1987 | Stowe et al. | 166/278 |
| 4,700,777 | A | 10/1987 | Luers | 166/185 |
| 4,733,723 | A | 3/1988 | Callegari, Sr. | 166/51 |
| 4,754,807 | A | 7/1988 | Lange | 166/236 |

(List continued on next page.)

FOREIGN PATENT DOCUMENTS

| | | | |
|---|---|---|---|
| CA | 2325761 | 11/2000 | E21B/43/08 |
| EP | 1087099 A1 | 3/2001 | |
| EP | 1132571 A1 | 9/2001 | |

OTHER PUBLICATIONS

Attard, M., Mathes, R. A. and Mower, L. N. (1990) "*Gravel Packing in an Abnormally Pressured Chalk Reservoir: A Valhall Field Case Study*", SPE 18226, Feb. 1990, pp. 14–20 and 482–484.

(List continued on next page.)

*Primary Examiner*—Thomas B. Will
*Assistant Examiner*—Jennifer R. Dougherty
(74) *Attorney, Agent, or Firm*—Drude Faulconer

(57) ABSTRACT

A well screen and method for gravel packing a wellbore interval wherein a low-viscosity slurry can be used to distribute the gravel. A well screen having a plurality of spaced intermediate manifolds is lowered into the interval and slurry is pumped down the well and into the first manifold. Each intermediate manifold has an upper and a lower perforated shunt tube in fluid communication therewith which, in turn, distribute slurry in both an upward and downward direction substantially simultaneously. The slurry exits the respective tubes into spaced zones within the completion interval. By overlapping the exit openings of respective lower and upper shunt tubes of adjacent manifolds, slurry will be delivered to across the entire completion interval.

18 Claims, 2 Drawing Sheets

U.S. PATENT DOCUMENTS

| | | | | |
|---|---|---|---|---|
| 4,818,403 | A | 4/1989 | Nagaoka | 210/488 |
| 4,856,591 | A | 8/1989 | Donovan et al. | 166/278 |
| 4,858,691 | A | 8/1989 | Ilfrey et al. | 166/278 |
| 4,915,172 | A | 4/1990 | Donovan et al. | 166/278 |
| 4,915,173 | A | 4/1990 | Davis | 166/278 |
| 4,932,474 | A | 6/1990 | Schroeder, Jr. et al. | 166/278 |
| 4,945,991 | A | 8/1990 | Jones | |
| 4,964,464 | A | 10/1990 | Myers | 166/278 |
| 4,969,522 | A | 11/1990 | Whitehurst et al. | 166/278 |
| 4,969,523 | A | 11/1990 | Martin et al. | 166/278 |
| 4,969,524 | A | 11/1990 | Whiteley | 166/278 |
| 5,069,279 | A | 12/1991 | Nagaoka | 166/234 |
| 5,082,052 | A | 1/1992 | Jones et al. | |
| 5,113,935 | A | 5/1992 | Jones et al. | |
| 5,161,613 | A | 11/1992 | Jones | |
| 5,161,618 | A | 11/1992 | Jones et al. | |
| 5,246,158 | A | 9/1993 | Nagaoka et al. | 228/175 |
| 5,307,984 | A | 5/1994 | Nagaoka et al. | 228/189 |
| 5,311,942 | A | 5/1994 | Nagaoka | 166/232 |
| 5,333,688 | A | 8/1994 | Jones et al. | |
| 5,333,689 | A | 8/1994 | Jones et al. | |
| 5,390,966 | A | 2/1995 | Cox et al. | |
| 5,417,284 | A | 5/1995 | Jones | |
| 5,419,394 | A | 5/1995 | Jones | |
| 5,435,391 | A | 7/1995 | Jones | |
| 5,476,143 | A | 12/1995 | Sparlin et al. | |
| 5,515,915 | A | 5/1996 | Jones et al. | |
| 5,560,427 | A | 10/1996 | Jones | |
| 5,588,487 | A | 12/1996 | Bryant | |
| 5,690,175 | A | 11/1997 | Jones | |
| 5,787,980 | A | 8/1998 | Sparlin et al. | 166/231 |
| 5,842,516 | A | 12/1998 | Jones | |
| 5,848,645 | A | 12/1998 | Jones | |
| 5,868,200 | A | 2/1999 | Bryant et al. | |
| 5,890,533 | A | 4/1999 | Jones | |
| 5,934,376 | A | 8/1999 | Nguyen et al. | |
| 6,003,600 | A | 12/1999 | Nguyen et al. | |
| 6,059,032 | A | 5/2000 | Jones | |
| 6,220,345 | B1 | 4/2001 | Jones et al. | |
| 6,227,303 | B1 | 5/2001 | Jones | |
| 6,230,803 | B1 | 5/2001 | Morton et al. | 166/278 |
| 6,298,916 | B1 | 10/2001 | Tibbles et al. | 166/278 |
| 6,302,207 | B1 | 10/2001 | Nguyen et al. | 166/276 |
| 6,405,800 | B1 * | 6/2002 | Walker et al. | 166/235 |
| 6,409,211 | B1 | 6/2002 | Sheng et al. | 280/730.2 |
| 6,409,219 | B1 | 6/2002 | Broome et al. | 285/3 |
| 6,427,775 | B1 | 8/2002 | Dusterhoft et al. | 166/278 |
| 6,446,722 | B2 | 9/2002 | Nguyen et al. | 166/278 |
| 6,481,494 | B1 | 11/2002 | Dusterhoft et al. | 166/51 |
| 6,497,284 | B2 | 12/2002 | van Petegem et al. | 166/297 |
| 6,516,881 | B2 | 2/2003 | Hailey, Jr. | 166/278 |
| 6,516,882 | B2 | 2/2003 | McGregor et al. | 166/278 |
| 2002/0066560 | A1 | 6/2002 | Dusterhoft et al. | 166/236 |
| 2002/0125007 | A1 | 9/2002 | McGregor et al. | 166/278 |
| 2002/0189809 | A1 | 12/2002 | Nguyen et al. | 166/278 |
| 2003/0000699 | A1 | 1/2003 | Hailey, Jr. | 166/278 |
| 2003/0000700 | A1 | 1/2003 | Hailey, Jr. | 166/278 |
| 2003/0000701 | A1 | 1/2003 | Dusterhoft et al. | 166/278 |
| 2003/0000702 | A1 | 1/2003 | Streich et al. | 166/278 |
| 2003/0010496 | A1 | 1/2003 | McGregor et al. | 166/278 |

OTHER PUBLICATIONS

Bercegeay, E. P. and Richard, C. A. (1974) "*A One–Trip Gravel Packing System*", SPE 4771, Feb. 7–8 1974, pp. 19–25 and Figs. 1–16.

Cox, Morris et al. (2002) "*Innovative Sand–Control Screen Assembly Enables Successful Multi–Lobe Frac Packs in Adverse Recompletion Conditions*", SPE 73723, Feb. 20–21, 2002, pp. 1–16.

Dickinson, W., Anderson, R. R., and Dykstra, H. (1987) "*Gravel Packing of Horizontal Wells*", SPE 16931, Sep. 27–30, 1987, pp. 519–528.

Duhon, P, Holley, A., Gardiner, N. and Grigsby, T. (1998) "*New Completion Techniques Applied to a Deepwater Gulf of Mexico TLP Completion Successfully Gravel Pack an Open–Hole Horizontal Interval of 2400 Feet*", SPE 50146, Oct. 12–14, 1998, pp. 477–487.

Durrett, J. L., Golbin, W. T., Murray, J. W. and Tighe, R. E. (1977) "*Seeking a Solution to Sand Control*", SPE 6210, Dec. 1977, pp. 1664–1672.

Elson, T. D., Darlington, R. H. and Mantooth, M. A. (1982) "*High–Angle Gravel Pack Completion Studies*", SPE 11012, Sep. 26–29, 1982, pp. 1–6, tables 1–3 and figs. 1–16.

Farley, Dave, "Gravel Pack Concept Solves Duning Problem," Petroleum Management, p. 44, 45 & 54, (Mar. 1986).

Forrest, J. K. (1990) "*Horizontal Gravel Packing Studies in a Full–Scale Model Wellbore*", SPE 20681, Sep. 23–26, 1990, pp. 647–655.

Foster, J., Gribsby, T. and LaFontaine, J. (1999) "*The Evolution of Horizontal Completion Techniques for the Gulf of Mexico. Where Have We Been and Where Are We Going*", SPE 53926, Apr. 21, 1999, pp. 1–15.

Grigsby, T. and Vitthal, S. (2002) "*Openhole Gravel Packing—An Evolving Mainstay Deepwater Completion Method*", SPE 77433, Sep. 2, 2002, pp. 1–16.

Gruesbeck, C., Salathiel, W. and Echols, E. (1979) "*Design of Gravel Packs in Deviated Wellbores*", SPE 6805, Jan. 1979, pp. 109–115.

Gruesbeck, C. and Collins, R. (1978) "*Particle Transport Through Perforations*", SPE 7006, Feb. 15–16, 1978, pp. 73–78, tables 1–4 and figs. 1–10.

Hudson, T. E. and Martin, J. W. (1988) "*Use of Low Density, Gravel–Pack Material Improves Placement Efficiency*", SPE 17169, Feb. 8–9, 1988, pp. 227–234.

Houchin, L. R., Dunlap, D. D. and Hutchinson, J. E. (1988) "*Formation Damage During Gravel–Pack Completions*", SPE 17166, Feb. 8–9, 1988, pp. 197–208.

Jones, L. G et al. (1991) "*Alternate Path Gravel Packing*" SPE 22796, Oct. 6–9, 1991, pp. 391–398.

LaFontaine, J. et al. (1999) "*New Concentric Annular Packing System Limits Bridging in Horizontal Gravel Packs*", SPE 56778, Oct. 3–6, 1999, pp. 1–11.

Ledlow, L. B., Sauer, C. W. and Till, M. V. (1985) "*Recent Design, Placement, and Evaluation Techniques Lead to Improved Gravel Pack Performance*", SPE 14162, Sep. 22, 1985, pp. 13, tables 1–3 and figs. 1–14.

Ledlow, Lewis (1985) "*A Quick Guide to Gravel Packing*", Oil Patch, vol. 10, No. 6, Aug. 1985, pp. 25–26.

Maly, G. P., Robinson, J. P. and Laurie, A. M. (1974) "*New Gravel Pack Tool for Improving Pack Placement*", SPE 4032, Journal of Petroleum Technology, Jan. 1974, pp. 19–24.

Nini, C. J. and Owen, G. W. (1983) "*Successful High–Angle Gravel Packing Techniques*", SPE 12105, Oct. 5–8, 1983, pp. 1–5, table 1 and figs. 1–6.

Parmigiano, J. M. (1976) "*Multizone Gravel–Pack Completion Method Works in High–Angle Holes*", Oil and Gas Journal, vol. 74, No. 2, Jan. 12, 1976, pp. 97–98.

Peden, J. M et al (1982) "*Laboratory Studies of the Effectiveness of Gravel Packing Perforations and Screen–Casting Annulus in Highly Deviated Wells*", EUR 311, European Petroleum Conference, London, England, Oct. 25–28, 1982, pp. 321–325, tables 1–3 and figs. 1–7.

Penberthy, W. L. and Cope, B. J. (1979) "*Design and Productivity of Gravel Packed Completions*", SPE 8428, 54th Ann. Fall Tech. Conf. Sep. 23–25, 1979, pp. 1–5, table 1 and figs. 1–19.

Penberthy, W. L. and Echols, E. E. (1991) "*Gravel Placement in Wells*", SPE 22793, Oct. 6–9, 1991, pp. 347–361.

Rensvold, R. F. and Decker, L. R. (1978) "*Full Scale Gravel Packing Model Studies*", EUR 39, European Petroleum Conference, London, England, Oct. 24–27, 1978, pp. 311–316 and figs 1–14.

Sanders, M. W. et al (2002) "*Gravel Pack Designs of Highly–Deviated Wells with an Alternative Flow–Path Concept*", SPE 73743, Feb. 20–21, 2002, pp. 1–16.

Saucier, R. J. (1974) "*Considerations in Gravel Pack Design*", Journal of Petroleum Technology, Feb. 1974, pp. 205–212.

Shryock, S. G. (1980) "*Gravel Packing Studies in a Full–Scale, Deviated Model Wellbore*", SPE 9421, Sep. 21–24, 1980, pp. 1–5, table 1 and figs. 1–13.

Solum, J. R. (1984) "*A New Technique in Sand Control Using Liner Vibration With Gravel Packing*", SPE 12479, Feb. 13–14, 1984, pp. 79–86, tables 1–4 and figs. 1–12.

Sparlin, D. D. (1987) "*Gravel Packing Innovations What's New?*" Drilling, Nov./Dec. 1987, pp. 17–20.

Sparlin, D. and Copeland, T. (1972) "*Pressure Packing With Concentrated Gravel Slurry*", SPE 4033, Oct. 8–11, 1972, pp. 1–7, table 1 and figs. 1–5.

Stiles, R. F., Colomb, G. T. and Farley, D. L. (1986) "*Development of a Gravity–Assisted Gravel pack System*", SPE 15409, Oct. 5–8, 1986, pp. 1–9, table 1 and figs. 1–12.

Von Flatern, Rick (2002) "*Surving the Screen Tests*", Offshore Engineer, Sep. 2002, pp. 29–32.

Wah, Kee Yong et al. (2002) "*New 7–in. Dual–Trip Multi-Zone Gravel Pack System Provide Cost Efficient Completions for Offshore China Development*" SPE 73728, Feb. 20–21, 2002, pp. 1–8.

Walvekar, S. and Ross, C. (2002) "*Production Enhancement Through Horizontal Gravel Pack*" SPE 73777, Feb. 20–21, 2002, pp. 1–10.

Welrich, J. B., Zaleski, T. E. and Tyler, S. L. (1990) "*One–Trip, Mulitzone Gravel–Packing Technique for Low-Pressure, Shallow Wells*" SPE Production Engineering, Nov. 1990, pp. 356–360.

Noor, M. Z. B. M et al. (2002) "*Enhanced Gravel–Pack Completions Revitalize a Mature Sand–Producing Field—A Case Study*" SPE 77919, Oct. 8–10, 2002, pp. 1–12.

Zaleski, Jr., T. E. (1989) "*Innovations in Completion Technology for Horizontal Wells*", Offshore, Feb. 1989, pp. 34–37.

Zaleski, Jr., T. E. and Spatz, E. (1988) "*Horizontal Completions Challenge for Industry*", Oil & Gas Journal, Offshore Report, May 2, 1988, pp. 58–70.

Baker Sand Control, "*Engineered Sand Control*", pp. 53–55; "Sand Control Technology", 1982–1983 Catalog.

Baker Sand Control, "*Gravel Pack Systems*", 1986–1987 Guide to Products and Services.

LaFontaine, Jackie et al. "New Concentric Annular Packing System Limits Bridging In Horizontal Gravel Packs", Oct. 3–6, 1999, SPE 56778, pp. 1–11.

Jones, Lloyd G. "Spectacular Wells Result From Alternate Path Technology", Petroleum Engineer International, Hart Publications, US, vol. 72, No. 5, May 1999, pp. 31–33, 36–38.

U.S. patent application Serial No. 09/642563, filed Aug. 22, 2000.

U.S. patent application Serial No. 09/629,203; filed Jul. 31, 2000.

* cited by examiner

METHOD AND APPARATUS FOR GRAVEL PACKING A WELL

DESCRIPTION

1. Technical Field

The present invention relates to the gravel packing of wells and in one of its aspects relates to a method and apparatus for gravel packing long intervals of a well.

2. Background of the Invention

In producing hydrocarbons or the like from certain subterranean formations, it is not uncommon to produce large volumes of particulate material (e.g. sand) along with the formation fluids. The production of this sand must be controlled or it can seriously affect the economic life of the well. One of the most commonly-used techniques for sand control is one which is known as "gravel packing".

In a typical gravel pack completion, a screen or the like is positioned within the wellbore adjacent the interval to be completed and a slurry of particulate material (i.e. "gravel"), is pumped down the well and into the annulus which surrounds the screen. As liquid is lost from the slurry into the formation and/or through the screen, gravel is deposited within the annulus to form a permeable mass around the screen which, in turn, permits produced fluids to flow into the screen while substantially screening out any particulate material.

A major problem in gravel packing, especially where long or inclined intervals are to be completed, is insuring that the gravel will be distributed throughout the completion interval. That is, if gravel is not distributed over the entire completion interval, the gravel pack will not be uniform and will have voids therein which reduces its efficiency.

Poor distribution of gravel across an interval is often caused by the premature loss of liquid from the gravel slurry into the formation as the gravel is being placed. This loss of fluid can cause the formation of "sand bridges" in the annulus which, in turn, block further flow of the slurry through the well annulus thereby preventing the placement of sufficient gravel (a) below the bridge in top-to-bottom packing operations or (b) above the bridge, in bottom-to-top packing operations.

To alleviate this problem, "alternate-path" well tools (e.g. well screens) have now been developed which provide good distribution of gravel throughout the entire completion interval even when sand bridges form before all of the gravel has been placed. In alternate-path well tools, perforated shunt tubes extend along the length of the tool and receive gravel slurry as it enters the well annulus which surrounds the tool. If a sand bridge forms in the annulus, the slurry can still flow through the perforated shunt tubes to be delivered to different levels in the annulus above and/or below the bridge to thereby complete the gravel packing of the annulus. For a more complete description of various alternate-path well tools (e.g.. gravel-pack screens) and how they operate, see U.S. Pat. Nos. 4,945,991; 5,082,052; 5,113,935; 5,515,915; and 6,059,032; all of which are incorporated herein by reference.

Alternate-path well tools, such as those described above, have been used to gravel pack relatively thick wellbore intervals (i.e. 100 feet or more) in a single operation. In such operations, the carrier fluid in the gravel slurry is typically comprised of a highly-viscous gel (i.e. greater than about 30 centipoises). The high viscosity of the carrier fluid provides the flow resistance necessary to keep the proppants (e.g. sand) in suspension while the slurry is being pumped out through the small, spaced openings along the perforated shunt tubes into the different levels of the annulus within the completion interval. However, as recognized by those skilled in the art, it is often advantageous to use low-viscosity fluids (e.g. water, thin gels, or the like; about 30 centipoises or less) as the carrier fluid for the gravel slurry since such slurries are less expensive, do less damage to the producing formation, give up the gravel more readily than do those slurries formed with more viscous gels, and etc.

Unfortunately, however, the use of low-viscosity slurries may present some problems when used in conjunction with "alternate path" screens for gravel-packing long, inclined, or horizontal intervals of a wellbore. This is primarily due to the low-viscosity, carrier fluid being prematurely "lost" through the spaced outlets (i.e. perforations) in the shunt tubes thereby causing the shunt tube(s), themselves, to "sand-out" at one or more of the perforations therein, thereby blocking further flow of slurry through the blocked shunt tube. When this happens, there can be no assurance that slurry will be delivered to all levels within the interval being gravel packed which, in turn, will likely produce a less than desirable gravel pack in the completion interval.

SUMMARY OF THE INVENTION

The present invention provides a well tool and method for gravel packing a long or inclined completion interval of a wellbore wherein the gravel is distributed throughout the interval even when using a low-viscosity slurry. Basically, a well screen having the slurry distribution system of the present invention thereon is lowered into the completion interval on a workstring. The slurry distribution system is comprised of a plurality of intermediate manifolds which are spaced along the length of screen and which are fluidly connected together. Slurry, which is comprised of a low-viscosity carrier fluid (e.g. water) and a proppant (e.g. sand), is pumped down the wellbore and is fed into the first intermediate manifold.

Where the well screen is to be used to complete an interval in a substantially vertical wellbore, the slurry may be supplied to the first intermediate manifold through at least one feed tube which is open at its upper end. Where the well screen is to be used to complete an interval in a substantially horizontal wellbore, a supply manifold may be provided which is fluidly connected to the first intermediate manifold by at least one feed tube and which receives slurry directly from a cross-over or the like in the workstring.

Each intermediate manifold has at least one upper shunt tube which extends upward therefrom and at least one lower shunt tube which extends downward therefrom. If a supply manifold is present, it will have only downward shunt tube(s) extending therefrom. Each shunt tube is perforated with a plurality of exit openings that are spaced along the outer length of the tube. A length (e.g. from about 2 feet to about ½ of the entire length of the tube) of each tube is preferably left blank (i.e. without openings) from the inlet end. This creates turbulent flow and prevents fluid loss from the slurry as it flows into a shunt tube thereby keeping the proppants in suspension until they exit the tube through the openings therein.

As the slurry fills the first intermediate manifold, it will flow substantially simultaneously upwardly through the upper shunt tube and downwardly through the lower shunt tube and will exit the respective tubes into zones which are spaced from each other within the annulus surrounding the screen.

The slurry then flows through a feed tube from the first intermediate manifold into a second manifold from which the slurry again flows both upward and downward substantially simultaneously through the respective shunt tubes, fluidly connected to the second intermediate manifold, and out the openings therein into different zones spaced from each other within said annulus. By overlapping the openings in a lower shunt tube of an upper manifold with the openings of an upper shunt tube of a lower manifold, slurry will be delivered to the complete interval which lies between the two respective manifolds. By providing sufficient intermediate manifolds to extend throughout the interval to be completed, gravel will be distributed to all zones within the interval even when using a low-viscosity slurry and/or if a sand bridge should form within the annulus before the gravel pack is complete.

BRIEF DESCRIPTION OF THE DRAWINGS

The actual construction, operation, and apparent advantages of the present invention will be better understood by referring to the drawings which are not necessarily to scale and in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

BEST KNOWN MODE FOR CARRYING OUT THE INVENTION

Figure 1:
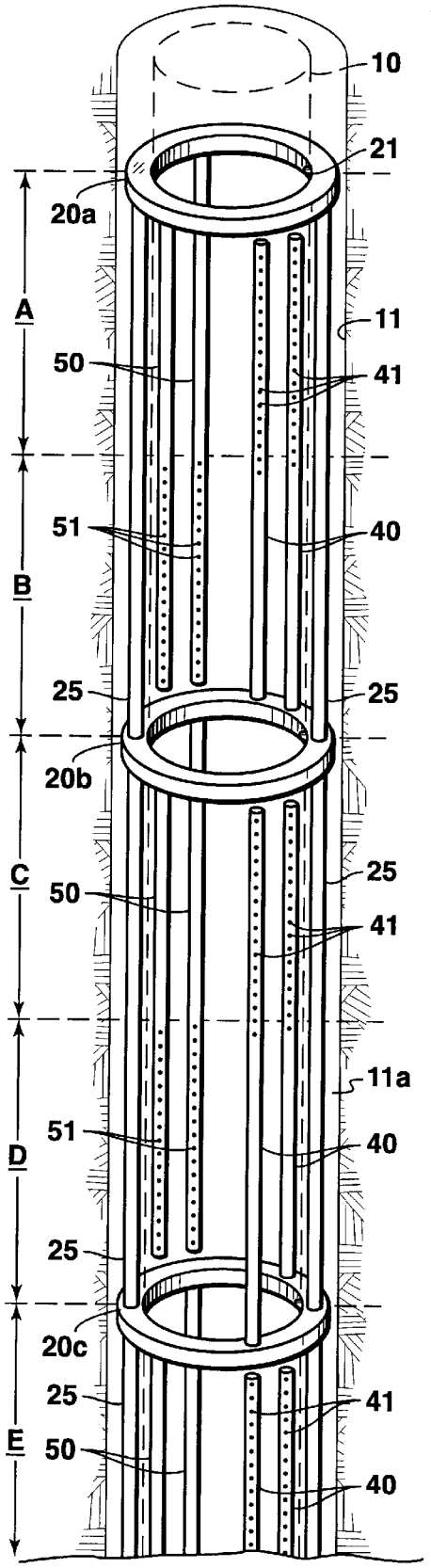
FIG. 1 is a simplified illustration of the alternate path tool of the present invention.
Figure 2:
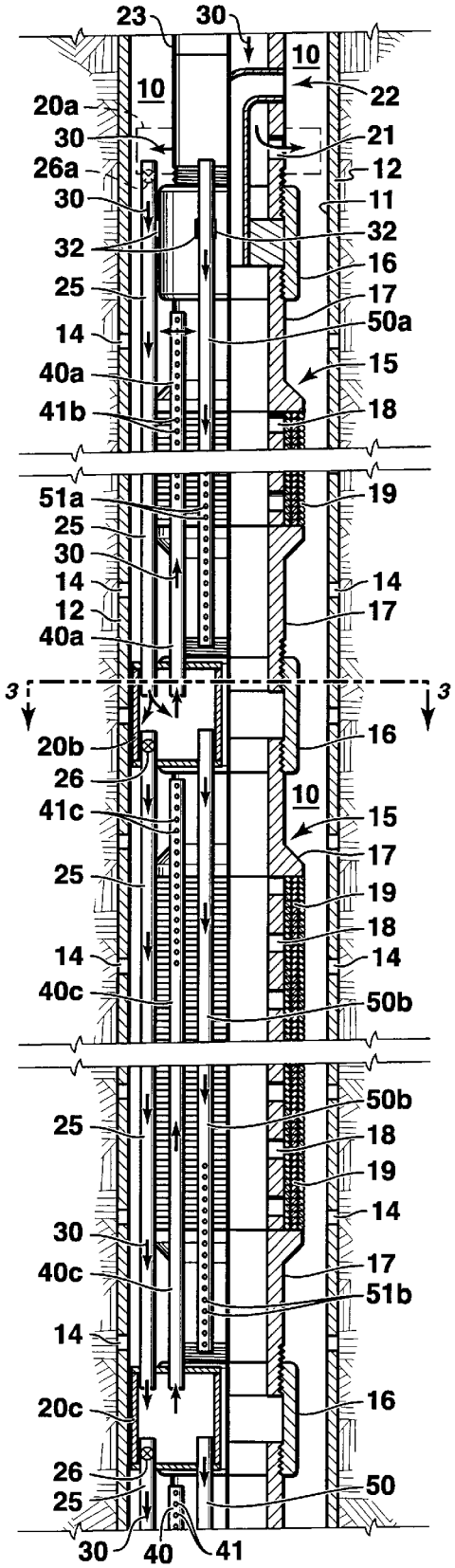
FIG. 2 is an elevational view, partly in section, of a detailed embodiment of the alternate path tool of FIG. 1.
Figure 3:
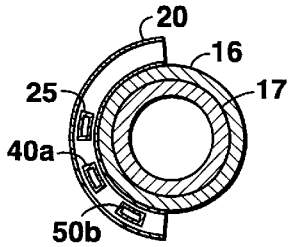
FIG. 3 is a cross-sectional view taken at lines 3—3 in FIG. 2.

Referring more particularly to the drawings, FIGS. 1 and 2 illustrate the concept and one embodiment of the present well tool 10 in an operable position within the lower end of a producing and /or injection wellbore 11. Wellbore 11 extends from the surface (not shown) and through a completion interval which is illustrated as one having a substantial length or thickness which extends vertically along wellbore 11 and as being made up of zones A, B, C, D, and E (only so designated in FIG. 1 for clarity). Wellbore 11, as shown in FIG. 2, is cased with casing 12 having perforations 14 throughout the completion interval, as will be understood in the art.

While wellbore 11 is illustrated in both FIGS. 1 and 2 as being a substantially vertical, cased well, it should be recognized that the present invention can be used equally as well in "open-hole" and/or underreamed completions as well as in horizontal and/or inclined wellbores. Since the present invention is applicable for use in horizontal and inclined wellbores, the terms "upper and lower", "top and bottom", etc., as used herein are relative terms and are intended to apply to the respective positions within a particular wellbore while the term "levels", when used, is meant to refer to respective positions lying along the wellbore between the terminals of the completion interval.

Well tool 10 (e.g. gravel pack screen, shown in FIG. 1 as dotted lines) may be of a single length or more likely, as shown in FIG. 2, is comprised of several joints 15 which are connected together with threaded couplings 16 or the like as will be understood in the art. As shown in FIG. 2, each joint 15 of gravel pack screen 10 is basically identical to each other and each is comprised of a perforated base pipe 17 having a continuous length of a wrap wire 19 wound thereon which forms a "screened" section therein. While base pipe 17 is shown as one having a plurality of perforations 18 therein, it should be recognized that other types of permeable base pipes, e.g., slotted pipe, etc., can be used without departing from the present invention.

Each coil of the wrap wire 19 is slightly spaced from the adjacent coils to thereby form fluid passageways (not shown) between the respective coils of wire as is commonly done in many commercially-available, wire-wrap screens, e.g. BAKERWELD Gravel Pack Screens, Baker Sand Control, Houston, Tex. Again, while one type of screen 10 has been specifically described, it should be recognized that the term "screen", as used throughout the present specification and claims, is meant to be generic and is intended to include and cover all types of similar well tools commonly used in gravel pack operations (e.g. commercially-available screens, slotted or perforated liners or pipes, screened pipes, prepacked or dual prepacked screens and/or liners, or combinations thereof).

In accordance with the present invention, well tool 10 includes a gravel slurry distribution system which is comprised of a plurality of manifolds 20 (e.g. 20*a*, 20*b*, 20*c*) which, in turn, are positioned along well tool 10. As shown in FIG. 2, each manifold is preferably positioned at or near a respective threaded coupling 16, primarily for the ease of assembly in making up a long well tool 10 in the field. Accordingly, the spacing between respective manifolds typically will be roughly equal to the length of a joint 15; e.g. 20–30 feet. Of course, the manifolds can be positioned and spaced differently along well tool 10 without departing from the present invention.

Each pair of adjacent intermediate manifolds (e.g. 20*b* and 20*c*) are fluidly connected together by at least one length of feed tube 25 (e.g. one shown in FIG. 2 and two in FIG. 1). Well tool 10 preferably includes a supply manifold 20*a* whenever well tool 10 is to be used to gravel pack a completion interval lying in an inclined or horizontal wellbore and is adapted to receive gravel slurry (arrows 30, only a few marked for clarity) directly from the outlet port 21 in cross-over 22 which, in turn, is connected between well tool 10 and workstring 23 (FIG. 2). Where well tool 10 is to be used in a substantially vertical well, supply manifold 20*a* can be eliminated, if desired, whereupon slurry 30 enters directly into the open end of feed tube 25 (i.e. supply tube) and down shunt tube 50*a*, the latter more fully described below. Where no supply manifold 20*a* is present, the upper ends of supply tube 25 and lower shunt tube 50*a* can be secured to tool 10 by welds 32 (FIG. 2) or the like.

Figure 4:
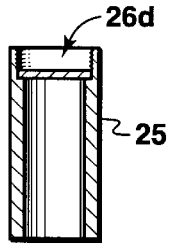
FIG. 4 is a partial sectional view of the upper end of a lower feed tube of the apparatus of FIG. 2 illustrating one type of valve means which can be used in the present invention.

Preferably, a pressure release valve 26 is positioned at or near the inlet of each feed tube 25, which lies within a manifold, for a purpose described. That is, normally there will be no valve 26 in the first feed or supply tube 25 if there is no supply manifold 20*a* present in tool 10. Valve 26 may be any type of valve which blocks flow when in a closed position and which will open at a predetermined pressure to allow flow of slurry through the feed tube. For example, valve 26 may be comprised of a disk 26*d* (FIG. 4) which is positioned within the inlet of a feed tube 25 and which will rupture at a predetermined pressure to open the feed tube to flow.

Figure 5:
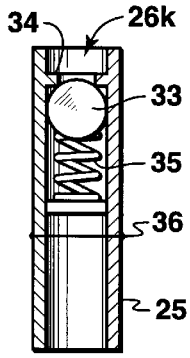
FIG. 5 is a partial sectional view of the upper end of another lower feed tube of the apparatus of FIG. 2 illustrating another type of valve means which can be used in the present invention.

Another example of a valve means 26 is check valve 26*k* (FIG. 5) which is positioned within the inlet of a feed tube 25. Valve 26*k* is comprised of a ball element 33 which is normally biased to a closed position on seat 34 by spring 35 which, in turn, is sized to control the pressure at which the valve will open. Valve means 26 is preferably made as a separate component which, in turn, is then affixed to the top of a respective shunt tube by any appropriate means, e.g. welds 36 (FIG. 5), threads (not shown), etc.

Fluidly connected to each intermediate manifold (e.g. second manifold 20*b*, third manifold 20*c* in FIGS. 1 and 2) are at least one upper shunt tube 40 and one lower shunt tube 50. FIG. 1 illustrates a plurality (e.g. two) of feed tubes 25, a plurality (e.g. two) of upper tubes 40, and a plurality (e.g. two) of lower tubes 50. Remember, "upper" and "lower" are meant to be relative terms in the case of well tool 10 being used in a horizontal wellbore with "upper" designating that position nearest the wellhead. The supply manifold 20*a* has at least one lower shunt 50 fluidly connected thereto while the lowermost manifold (not shown) in the slurry distribution system would have at least one upper shunt tube 40 fluidly connected thereto in order to insure that slurry will be delivered to all levels within the completion interval. Each upper shunt tube 40 and each lower shunt tube 50 are of a length sufficient to extend effectively between their two respective manifolds 20, the reason for which will become evident from the following discussions.

Each shunt tube, both 40 and 50, is perforated with spaced openings 41, 51, respectively, (only a few numbered for clarity's sake). Preferably, each shunt tube will be perforated only along a portion of its length towards its outer end, leaving a substantial inlet portion of each shunt tube (i.e. a length of at least about 2 feet up to about one-half of the length of the shunt tube) blank (i.e. having no exit openings) for a purpose to be discussed below. Also, each of the shunt tubes 40, 50, as well as the feed tubes 25, are preferably formed so that their respective ends can easily be manipulated and slid into assigned openings in the respective manifolds and sealed therein by known seal means (e.g. O-rings or the like, not shown) so that the respective manifolds and tubes can be readily assembled as tool 10 is made up and lowered into the wellbore.

Now referring primarily to FIG. 1, it is seen that each of the upper shunt tubes 40 and the lower shunt tubes 50, which effectively extend between two adjacent manifolds 20, are perforated over a sufficient outer portion of its length whereby the respective perforated sections overlap each other when tool 10 is in an operable position within a completion interval. That is, the lower tube(s) 50 which extend downward from supply manifold 20*a* are perforated along their lower portions whereby slurry flowing through these tubes will exit into the well annulus 11*a* adjacent zone B in the completion interval. Substantially at the same time, slurry will flow downward through feed tube 25 into the intermediate manifold 20*b* and then upward through upper shunt tube 40*a* to exit adjacent zone A, thereby insuring that slurry will be delivered to the entire length of the completion interval lying between supply manifold 20*a* and second manifold 20*b*. It should be evident that this sequence is then repeated through the other manifolds which lie below manifold 20*b* to complete the gravel pack operation.

By leaving the inlet portion of each shunt tube blank, the slurry encounters a certain resistance as it flows within this blank portion thereby creating turbulent flow which aids in keeping the proppants (e.g. sand) in suspension until the slurry reaches the exit openings at the outer or exit end of the tube. Also, since there are no openings in the blank portion of each shunt tube, there can be no loss of fluid from the slurry so the probability of premature sand-out in the shunt tube is virtually eliminated.

Once a gravel pack has deposited around a screen joint, the pack begins to back up inside a respective shunt tube. However, the relatively long length of the blank portion of each tube assures that any on-going fluid loss through that shunt tube is minute; thus, providing the required diversion of slurry necessary to assure packing of the entire completion interval.

A typical gravel pack operation using the present invention will now be set forth. Screen 10 is assembled and lowered into wellbore 11 on a workstring 23 (FIG. 2) and is positioned adjacent the completion interval (i.e. zones A, B, C, D, and E in FIG. 1). A packer (not shown) can be set if needed as will be understood in the art. Gravel slurry 30 is pumped down the workstring 23, out through openings 21 in cross-over 22, and into the supply manifold 20*a* (i.e. present for use in horizontal wellbore) or directly into the open upper ends of feed tube 25 and lower shunt tube 50 (i.e. there may be no supply manifold 20*a* if completion is in vertical wells). While high-viscosity slurries can be used, preferably the slurry used is one which is formed with a low-viscosity carrier fluid and proppants, e.g. sand. As used herein, "low-viscosity" is meant to cover fluids which are commonly used for this purpose and which have a viscosity of 30 centipoises or less (e.g. water, low viscosity gels, etc.).

The slurry 30 fills supply manifold 20*a*, if present, and flows through lower shunt tube 50*a* to exit through openings 51 into the annulus adjacent zone B. Initially, pressure release valve 26*a*, if present, blocks flow through the feed tube 25*a* (FIG. 2) thereby blocking flow from the supply manifold 20*a* to intermediate manifold 20*b*. Valve 26*a* is set to open when the pressure in supply manifold rises to a valve slightly in excess (e.g. 20–30 psi) of the original pump pressure of the slurry. This insures that supply manifold 20*a* and lower shunt tube 50*a* are filled and flowing before valve 26*a* opens to allow slurry to flow to the second manifold 20*b*.

Slurry 30 fills intermediate manifold 20*b* and now flows upward through upper shunt tube 40*b* and downward through lower shunt tube 50*b*. Since openings 41 in upper shunt tube 40*b* and openings 51 in lower shunt tube 50*a* overlap, slurry will be delivered to all of that portion of the completion interval lying being the supply manifold 20*a* and the first intermediate manifold 20*b*. Further, since the inlet portion of each shunt tube is blank, there is no fluid loss from the slurry as it flows through this blank portion, this being important where low-viscosity slurries are used. Still further, the resistance to flow provided by the small inner dimensions of the tubes will produce turbulent flow which, in turn, aids in keeping the proppants in suspension until the slurry exits through the openings in the respective tubes.

Once intermediate manifold 20*b* and its associated shunts are filled, the pressure will inherently increase therein which, in turn, opens valve 26*b* to allow slurry to flow to the next lower intermediate manifold 20*c*. Slurry then fills manifold 20*c* and its associated upper and lower shunt tubes and the process continues until all of the manifolds and shunt tubes in a particular well tool have been supplied with slurry.

It can be seen from FIG. 1 that since the openings in adjacent shunt tubes are overlapped, slurry will be distributed to all portions (e.g. zones A, B, C, D, and E) of the completion interval thereby producing a good gravel pack throughout the completion interval.

What is claimed is:

1. A well tool for gravel packing a completion interval within a wellbore, said well tool comprising:

a screen section; and a slurry distribution system comprising:

a plurality of intermediate manifolds, said manifolds being spaced from each other along said screen section;

at least one unperforated feed tube fluidly connecting adjacent pairs of said intermediate manifolds together;

at least one upper shunt tube fluidly connected to each of said intermediate manifolds and extending upward therefrom along said screen section;

said at least one upper shunt tube having openings spaced along at least a portion of the length thereof;

at least one lower shunt tube fluidly connected to each of said intermediate manifolds and extending downward therefrom along said screen section;

said at least one lower shunt tube having openings spaced along at least a portion of the length thereof; and means adapted to supply slurry to said plurality of said manifolds.

2. The well tool of claim 1 wherein said means adapted to supply slurry to said plurality of manifolds comprises:

an unperforated feed tube fluidly connected to the uppermost of said plurality of intermediate manifold and extending upward therefrom, said supply tube being open at its upper end adapted to receive said slurry as said slurry flows into said completion interval around said tool.

3. The well tool of claim 1 wherein said means adapted to supply slurry to said plurality of manifolds comprises:

a supply manifold adapted to receive said slurry as said slurry flows into said completion interval; and at least one unperforated feed tube fluidly connecting said supply manifold to said plurality of intermediate manifolds.

4. The well tool of claim 3 including:

at least one lower shunt tube fluidly connected to said supply manifold and extending downward along said screen;

said at least one lower shunt tube having openings spaced along at least a portion of the length thereof.

5. The well screen of claim 1 including:

a valve in said at least one feed tube for initially blocking flow through said feed tube and adapted to open when the pressure in said supply manifold increases to a predetermined value.

6. The well tool of claim 1 wherein said openings in each of said at least one upper and at least one lower shunt tubes are spaced along the outer length of each respective said shunt tubes whereby a portion of the length of each said tube will be blank at the inlet end thereof.

7. The well tool of claim 6 wherein the blank portion of the length of each said tube will be from about 2 feet in length to about ½ of the entire length of said tube.

8. The well tool of claim 1 wherein said openings in said at least one upper shunt tube extending upward from one of said plurality of intermediate manifolds overlap said openings in said at least one lower shunt tube extending downward from another of said plurality of intermediate manifolds.

9. A well tool for gravel packing a completion interval within a wellbore, said well tool comprising:

a screened section; and a slurry distribution system comprising:

a supply manifold positioned near the upper end of said screen section, said supply manifold comprising;

means adapted to supply slurry to said supply manifold; and at least one lower shunt tube having openings spaced along at least a portion of the length thereof, said lower shunt tube being fluidly connected to said supply manifold and extending downward therefrom along said screen section; and a first intermediate manifold positioned on said screen section and spaced from said supply manifold, said first intermediate manifold comprising;

at least one upper shunt tube having openings spaced along at least a portion of the length thereof, said upper shunt tube being fluidly connected to said first intermediate manifold and extending upward therefrom along said screen section; and a first unperforated feed tube fluidly connecting said supply manifold to said first intermediate manifold.

10. The well screen of claim 9 wherein said first intermediate manifold further includes:

at least one lower shunt tube having openings spaced along at least a portion of the length thereof, said lower shunt tube being fluidly connected to said first intermediate manifold and extending downward therefrom along said screen section.

11. The well screen of claim 10 including:

a second intermediate manifold positioned on said screen section and spaced from said first intermediate manifold, said second intermediate manifold comprising;

at least one upper shunt tube having openings spaced along at least a portion of the length thereof, said upper shunt tube being fluidly connected to said second intermediate manifold and extending upward therefrom along said screen section; and a second unperforated feed tube fluidly connecting said first intermediate manifold to said second intermediate manifold.

12. The well screen of claim 11 including:

a valve in each of said feed tubes for initially blocking flow through said respective feed tube and adapted to open when the pressure on said valve increases to a predetermined value.

13. The well tool of claim 11 wherein said openings in each of said at least one upper and at least one lower shunt tubes are spaced along the outer length of each respective said shunt tubes whereby a portion of the length of each said tube will be blank at the inlet end thereof.

14. The well tool of claim 13 wherein said blank portion of the length each said tube will be from about 2 feet in length to about ½ of the entire length of said tube.

15. The well tool of claim 13 wherein said openings in said at least one upper shunt tube extending upward from one of said plurality of intermediate manifolds overlap said openings in said at least one lower shunt tube extending downward from another of said plurality of intermediate manifolds.

16. A method of gravel packing a completion interval in a wellbore, said method comprising:

lowering a well screen having a slurry distribution system thereon into said completion interval whereby an annulus is formed between said well screen and the wall of the wellbore;

said slurry distribution system comprising a plurality of manifolds which are fluidly connected together;

supplying a slurry comprised of a carrier fluid and a proppant down said wellbore and into the first of said plurality of manifolds;

flowing said slurry both upward and downward substantially simultaneously from said first manifold and into zones spaced from each other within said annulus around said screen;

flowing said slurry into the second of said plurality of manifolds; and flowing said slurry both upward and downward substantially simultaneously from said second manifold into different zones spaced from each other within said annulus around said well screen.

17. The method of claim 16 wherein said carrier fluid is a fluid having a viscosity of less than about 30 centipoises.

18. The method of claim 17 wherein said carrier fluid is water.

* * * * *